US011644163B2

(12) United States Patent
St. Ives

(10) Patent No.: US 11,644,163 B2
(45) Date of Patent: May 9, 2023

(54) CAST IN-GROUND LIGHTING ASSEMBLY

(71) Applicants: ORGANIC LIGHTING SYSTEMS, INC., Orange, CA (US); Laurence Robert St. Ives, Orange, CA (US)

(72) Inventor: Laurence Robert St. Ives, Las Vegas, NV (US)

( * ) Notice: Subject to any disclaimer, the term of this patent is extended or adjusted under 35 U.S.C. 154(b) by 0 days.

(21) Appl. No.: 17/617,865

(22) PCT Filed: Jun. 3, 2020

(86) PCT No.: PCT/US2020/035943
§ 371 (c)(1),
(2) Date: Dec. 9, 2021

(87) PCT Pub. No.: WO2020/251822
PCT Pub. Date: Dec. 17, 2020

(65) Prior Publication Data

US 2022/0243881 A1 Aug. 4, 2022

(51) Int. Cl.

| | |
|---|---|
| ***F21S 8/02*** | (2006.01) |
| ***F21V 15/01*** | (2006.01) |
| ***F21V 19/00*** | (2006.01) |
| ***F21V 17/10*** | (2006.01) |
| ***F21S 4/28*** | (2016.01) |
| ***F21V 21/005*** | (2006.01) |
| *F21Y 115/10* | (2016.01) |
| *F21W 131/10* | (2006.01) |

(52) U.S. Cl.
CPC ..... *F21S 8/022* (2013.01); *F21S 4/28* (2016.01); *F21V 15/01* (2013.01); *F21V 17/107* (2013.01); *F21V 19/001* (2013.01); *F21V 21/005* (2013.01); *F21W 2131/10* (2013.01); *F21Y 2115/10* (2016.08)

(58) Field of Classification Search
CPC .. F21S 8/022; F21S 4/28; F21V 15/01; F21V 21/005
See application file for complete search history.

(56) References Cited

U.S. PATENT DOCUMENTS 5,160,202 A * 11/1992 Legare ..... F21S 8/08 362/153.1
5,390,090 A * 2/1995 Nau ..... F21V 33/006 362/153.1
6,027,280 A * 2/2000 Conners ..... E01F 9/559 362/153.1
6,062,710 A * 5/2000 Hewitt ..... F21V 5/002 362/311.03
6,334,695 B1 * 1/2002 Abe ..... E01F 9/559 362/153.1

(Continued)

OTHER PUBLICATIONS

Gorilla Heavy Duty Construction Adhesive, http://pdf.lowes.com/productdocuments/c59b3484-25ff-4ddf-9161-d983d2ba469d/44313120.pdf published 2018 (Year: 2018).*

*Primary Examiner* — Evan P Dzierzynski
(74) *Attorney, Agent, or Firm* — David B Abel

(57) ABSTRACT

A cast concrete durable light fixture design and assembly that will allow in-ground lighting features for roadways, pathways and architectural features providing a simple installation for a drive over in-grade or in-ground lighting fixture. The cast concrete design enables curves and shapes to be manufactured as easily as straight or linear configurations.

24 Claims, 9 Drawing Sheets

(56) References Cited

U.S. PATENT DOCUMENTS

| | | | | |
|---|---|---|---|---|
| 7,070,294 | B2 * | 7/2006 | Patti | E01C 17/00 362/153.1 |
| 2006/0291197 | A1 * | 12/2006 | Patti | F21V 21/04 362/153.1 |
| 2018/0023303 | A1 * | 1/2018 | MacDonald | E04F 13/0801 52/386 |
| 2020/0149715 | A1 * | 5/2020 | Zeman | F21S 8/022 |
| 2020/0393097 | A1 * | 12/2020 | St.Ives | F21V 15/01 |

* cited by examiner

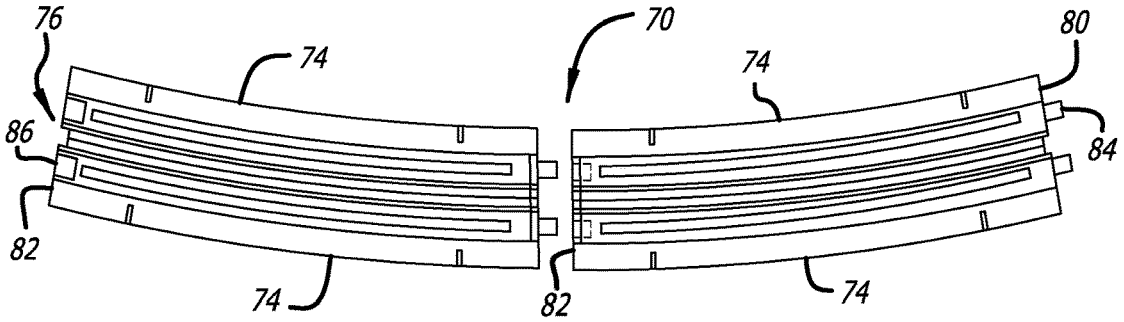
FIG. 7A
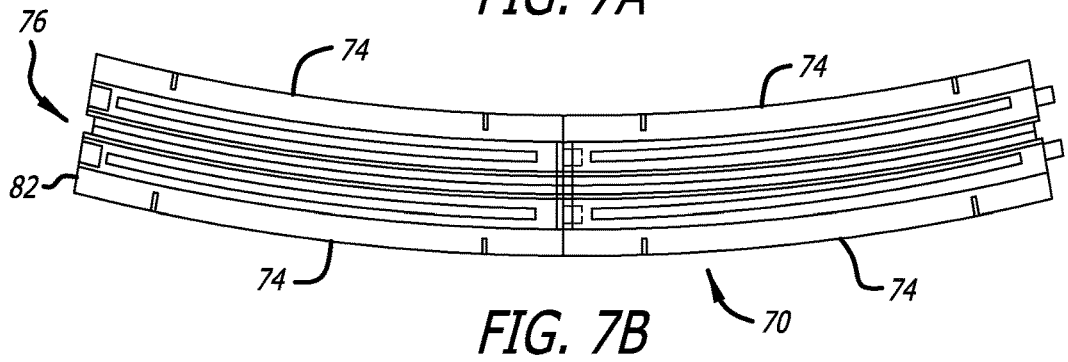
FIG. 7B
FIG. 8
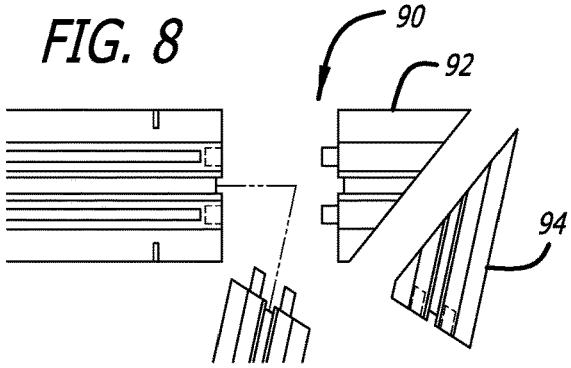
FIG. 9
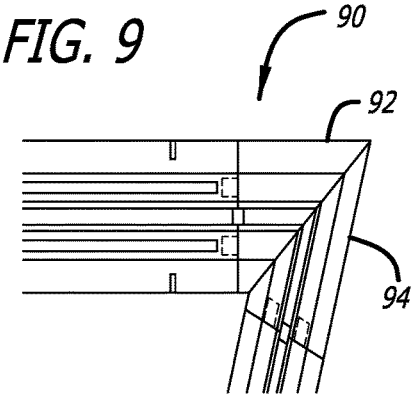
FIG. 10A
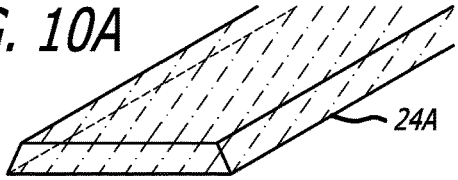
FIG. 10B
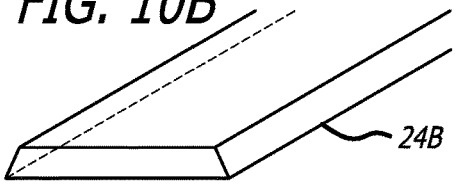
FIG. 11
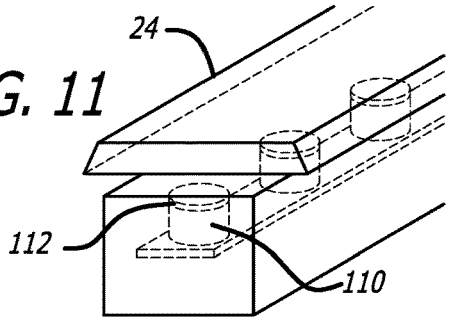
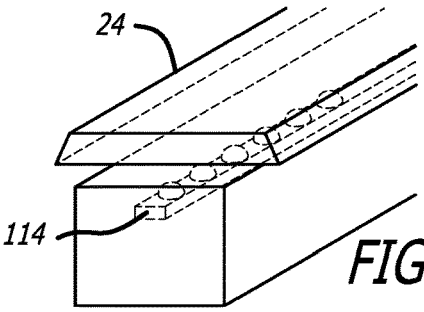
FIG. 12

CAST IN-GROUND LIGHTING ASSEMBLY

BACKGROUND AND PRIOR ART

In-ground or below grade lighting systems provide a number of desirable benefits and enhancements to building designs and architectural features. In-ground linear lighting can be used to create unobtrusive, directional or decorative illumination in pedestrian or vehicular traffic areas, which will not obstruct traffic. Placing the lighting features in-ground has an added benefit of making the lighting vandal resistant. In-ground lighting can be used to delineate pathways and access points or to direct illumination on architectural structures and facades. However, in-ground lighting systems are exposed to a number of environmental factors, including water, salt water, corrosive materials and chemicals, requiring special design considerations. Examples of in-ground lighting systems are disclosed in U.S. Pat. Nos. 7,478,916; 9,638,381; 9,784,440 and 10,082,260.

In-ground light fixtures intended to be used in roadways, driveways and entrances, which may be called "drive over" lighting fixtures, further require a durable and structurally sound assembly. In-ground drive over resistant lighting fixtures have a shell or body made from metal, often stainless steel or aluminum, where the shell or body is fixed in the ground to be back-filled and surrounded by concrete or pavers. After setting the concrete or pavers around the body, a secondary waterproof sealed lighting fixture is then installed in the body. The strong supporting metal body together with the lighting fixture is then capable of supporting considerable weight of drive over traffic without being distorted or crushed. Stainless steel is usually the preferred material body as it resists corrosive elements which may be present in many soil conditions, or where salt water or chemicals could cause materials such as aluminum to have a galvanic reaction, resulting in corrosion and weakening of the fixture.

The high cost of the metal components and the lighting fixture plus additional costs associated with complicated installation cause the application of existing drive over lighting fixtures to be prohibitively expensive to install for many locations. Existing available inground lighting fixtures are also limited to single cans or in some cases straight line assemblies, as the cost and complexity of manufacturing and installing curved or custom fixtures is more expensive and complex making them impractical. An in-ground lighting structure having a simple yet variable design which could be installed more easily with less associated expense, and which would also resist corrosion, would be beneficial to the industry and could become a preferred option for in-ground lighting systems.

BRIEF DESCRIPTION OF THE INVENTION

The present invention is directed to a cast concrete durable light fixture design that will reduce the parts and materials required and facilitate a simpler installation of a drive over in-grade or in-ground lighting fixture. The cast concrete design enables curves and other nonlinear shapes and even crossover configurations to be manufactured as easily as straight or linear configurations. Casting fixtures as precast interlocking sections from concrete, polymer concrete mixtures or other non-corrosive structural materials, which will withstand heavy drive over traffic, solves the environmental problems associated with present metal body in-ground lighting system applications in a cost-effective configuration.

The present invention optimizes the advantages of light emitting diode (LED) lights for in-ground lighting architectural products. LED versions can provide colored or color changing effects. The miniature size of LEDs enables the creation of narrow linear images. The long life of the LEDs are particularly suitable for the in-ground applications due to their long useful lifetime as compared to other types of lights, and the LED's require limited maintenance. Recent developments of long flexible LED strips with miniaturized electronics using standard line voltages, which can be run continuously in lengths as long as 300 feet, enable new fixture designs to be created which are free-form as well as straight linear lines. In addition, because of the LED low energy requirements, they can be used economically due to their energy efficiency. The cast concrete durable light fixture designs of the present invention also allow the installation of the cast concrete shell and body components to be installed on location, and the subsequent installation of the lighting and electrical components.

BRIEF DESCRIPTION OF THE DRAWINGS

FIG. 7 is a top view of a third embodiment of the cast concrete body of an in-ground lighting assembly of the present invention having a curved design;

FIG. 8 is a top view of illustrating the steps of forming an angled corner assembly using the cast concrete body of an in-ground lighting assembly of the present invention;

FIG. 9 is a top view of a finished corner assembly formed from the cast concrete body of an in-ground lighting assembly of the present invention;

FIG. 10A is a perspective view of a light diffusing lens for the in-ground lighting assembly of the present invention;

FIG. 10B is a perspective view of a clear lens for the in-ground lighting assembly of the present invention;

FIG. 11 is a perspective view of an assembly having multiple discrete LEDs for the in-ground lighting assembly of the present invention;

FIG. 12 is a perspective view of a strip LED light assembly for the in-ground lighting assembly of the present invention;

DETAILED DESCRIPTION OF THE INVENTION

Figure 1:
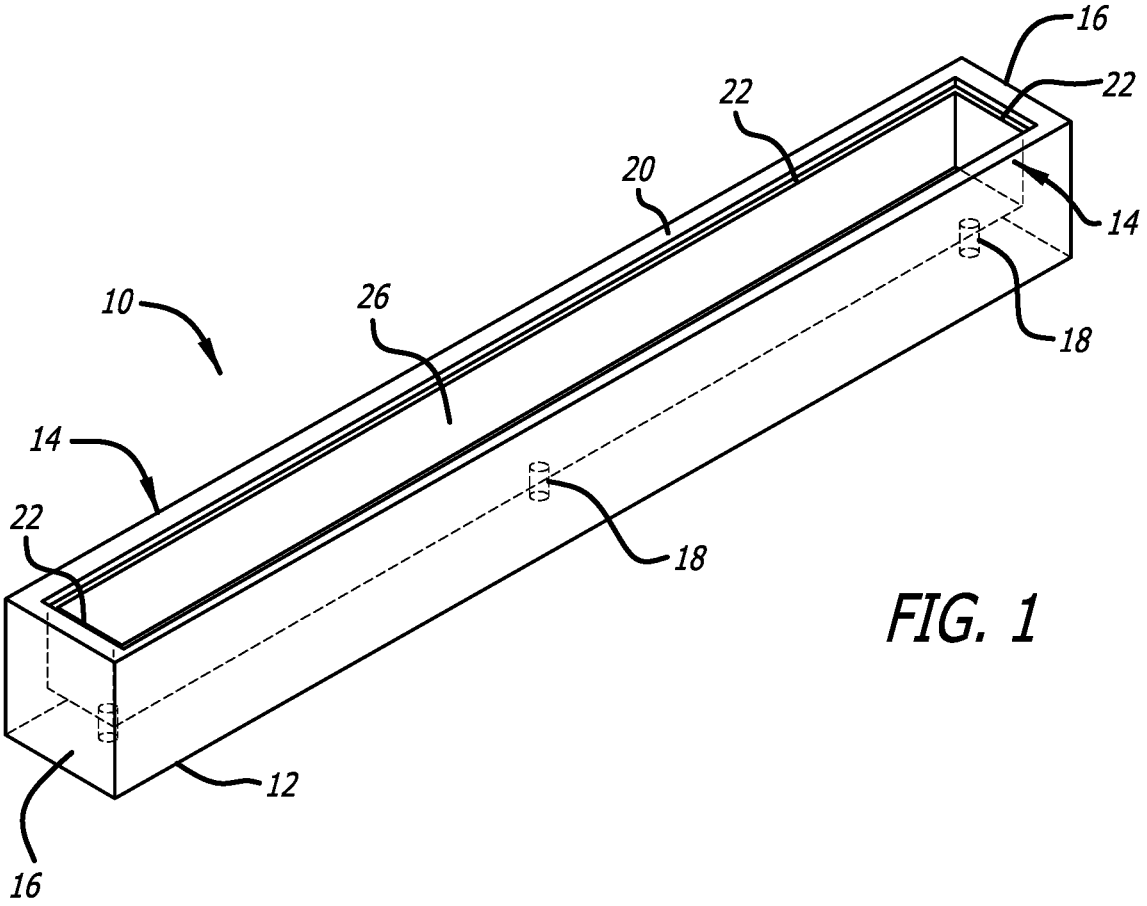
FIG. 1 is a perspective view of a first embodiment of the cast concrete body of an in-ground lighting assembly of the present invention.
Figure 2:
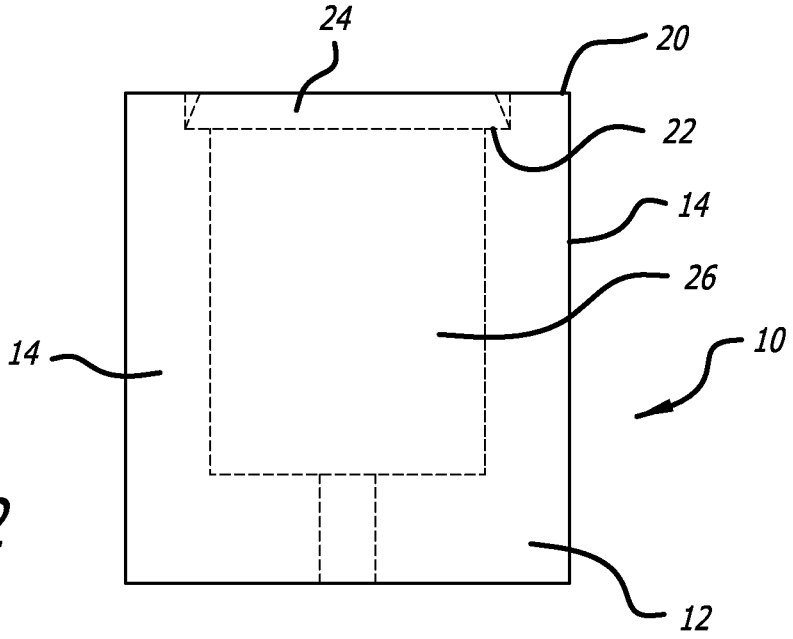
FIG. 2 is an end view of the first embodiment of the cast concrete body of an in-ground lighting assembly of the present invention.

FIG. 1 is a perspective view and FIG. 2 is an end view of a first embodiment of the cast concrete body 10 of an in-ground lighting assembly of the present invention. The cast concrete body 10 includes a base 12 and sidewalls 14 extending upward from the outer edges of the base 12. The cast concrete body 10 may also include endcaps 16. The cast concrete body 10 may be formed in the shape of a square or rectangle with three-quarters of an inch to twelve inch wide base and three-quarters of an inch to six inch tall sides, and up four or even eight feet in length. The base 12 may include one or more drain holes 18 that can also be used to allow wiring access to the interior of the cast concrete body 10. The top edges 20 of the sidewalls 14 as well as the endcaps 16 preferably include a shoulder 22 formed to support the edges of a lens 24, as illustrated in the end view of FIGS. 1 and 2. The base 12 and sidewalls 14 form an open channel 26 for placement of electrical elements including lights, preferably light emitting diode (LED) lighting fixtures, however other types of lighting devices such as liquid crystal displays (LCD) and laser lights may also be incorporated into the channel 26. The cast concrete body 10 is constructed of sufficiently durable materials so as to allow the cast concrete body 10 to be installed in-ground or even in-pavement, with only the upper surface of the lens 24 and top edges 20 of the sidewalls 14 being exposed. The base 12, sidewalls 14 and endcaps 16 of the lighting fixture cast concrete body 10 are formed from concrete, polymer concrete mixtures or other non-corrosive castable or moldable structural materials including high strength plastics and high strength polymers. For in-ground, drive-over installations, the cast concrete body 10 must be capable of supporting a small vehicle, and thus at least 150 kPa (kilo Pascals) and preferably it should be capable of supporting up to 700 kPa to withstand the weight of trucks.

Figure 3:
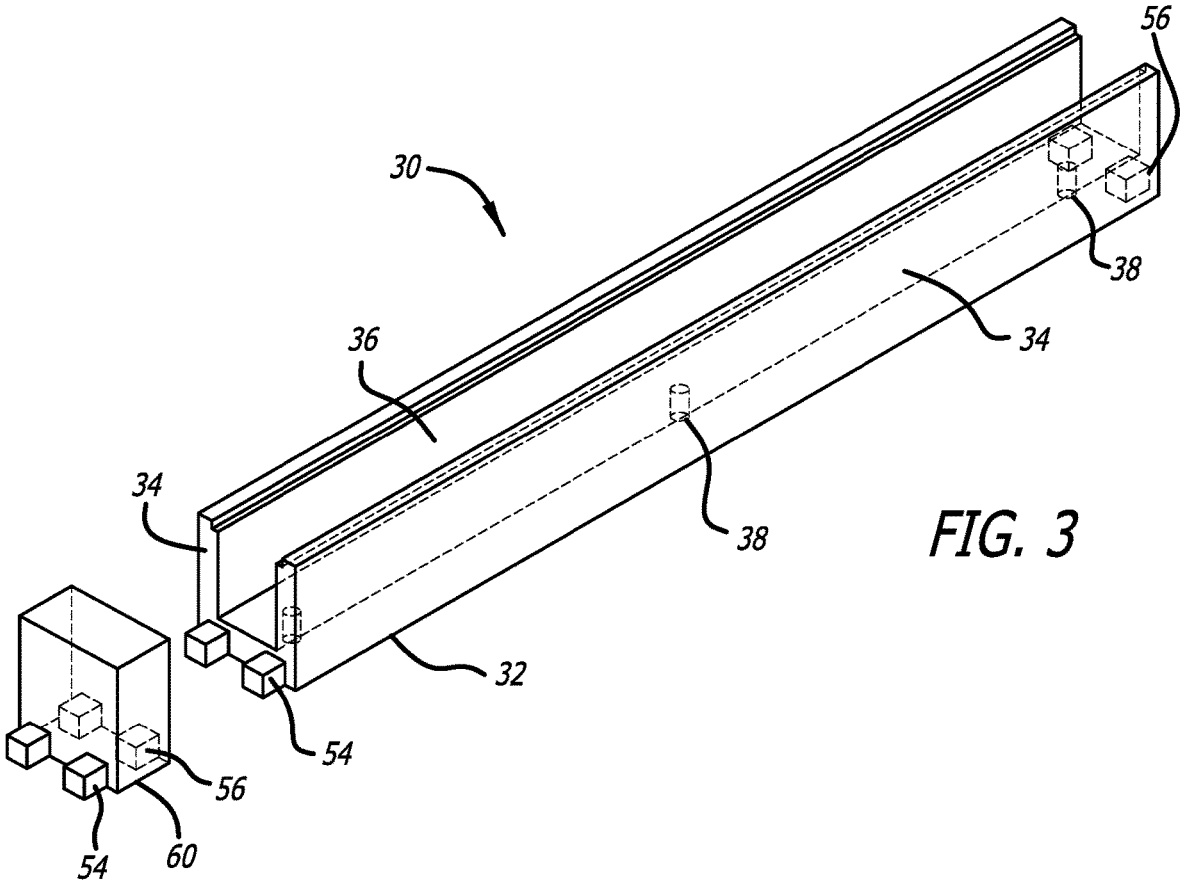
FIG. 3 is a perspective view of a second embodiment of the cast concrete body of an in-ground lighting assembly of the present invention.
Figure 4:
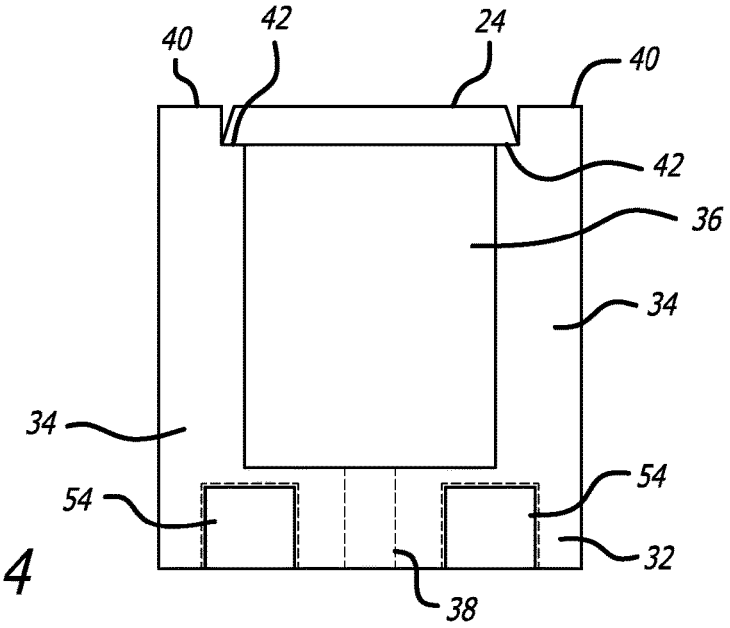
FIG. 4 is an end view of the second embodiment of the cast concrete body of an in-ground lighting assembly of the present invention depicting the channel for LED lighting arrays, drainage hole and interlocking connector feature and lens support ledges.

FIG. 3 is a perspective view and FIG. 4 is an end view of a second embodiment of the cast concrete body 30 of an in-ground lighting assembly of the present invention. The cast concrete body 30 includes a base 32 and sidewalls 34 extending upward from the outer edges of the base 32. The base 32 may include one or more drain holes 38. As depicted in FIGS. 3 and 4, the cast concrete body 30 forms an open-ended channel 36 for receiving the LED lighting arrays. The top surfaces 40 of the sidewalls 34 each include shoulders 42 to support a lens 24. The respective ends 44 and 46 of the cast concrete body 30 preferably include interlocking male 54 and female 56 connector features. The connector features are depicted as having square shapes, although it should be understood that the connector features could have other cross-sectional shapes including round, oval, triangles and rectangular shapes. The connector features allow the easy assembly of two or more of the cast concrete bodies 30 end to end allowing assemblies up to several hundred feet in length. The ends of the cast concrete body 30 may be sealed with endcaps 60 having similar male and female connecting features as necessary to secure the open ends of the channel 36 as illustrated in FIG. 3. The endcaps 60 may also include a shoulder (not shown) to support the end of the elongated lens. In addition, the endcaps may include a hole or punch-out, or they may be drilled, to accommodate wiring for the light devices.

Figure 5A:
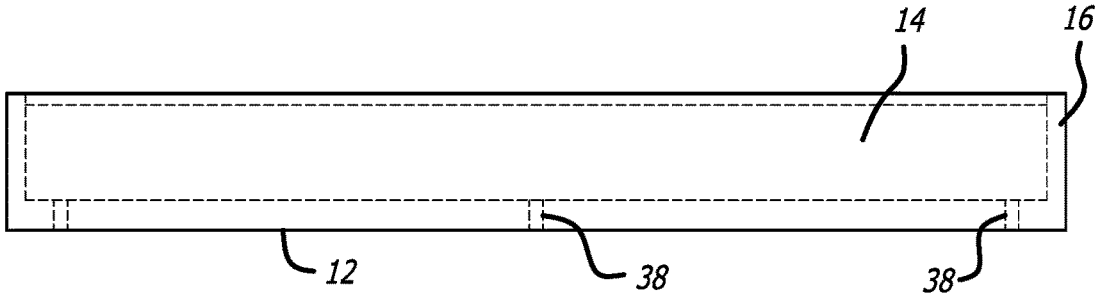
FIG. 5A is a side view of the first embodiment of the cast concrete body of an in-ground lighting assembly of the present invention.
Figure 5B:
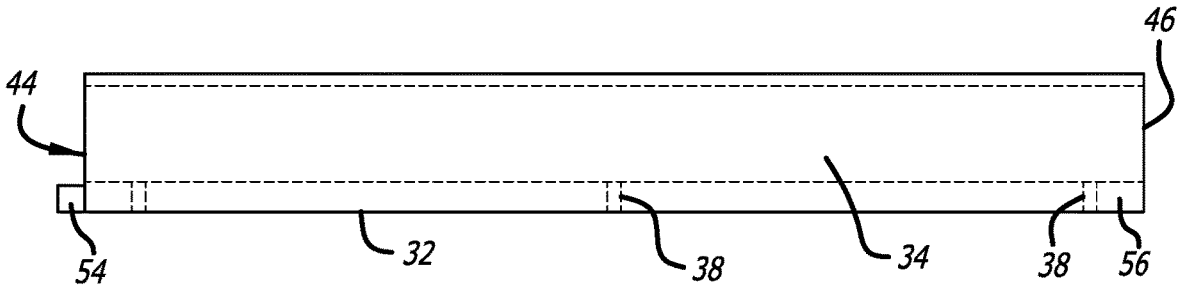
FIG. 5B is a side view of the second embodiment of the cast concrete body of an in-ground lighting assembly of the present invention.
Figure 6A:
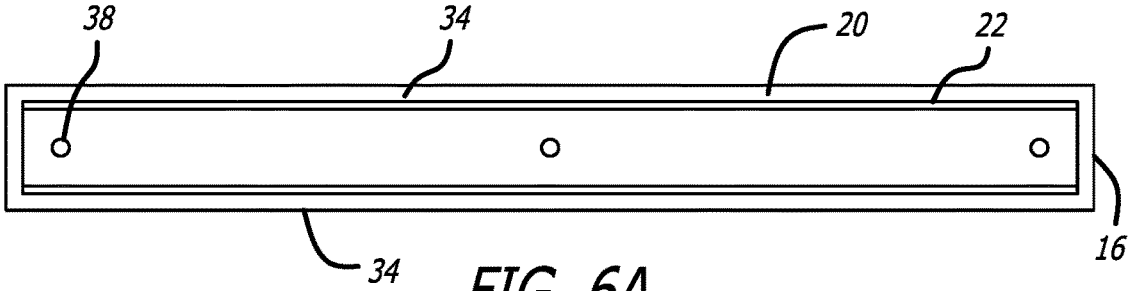
FIG. 6A is a top view of the first embodiment of the cast concrete body of an in-ground lighting assembly of the present invention.
Figure 6B:
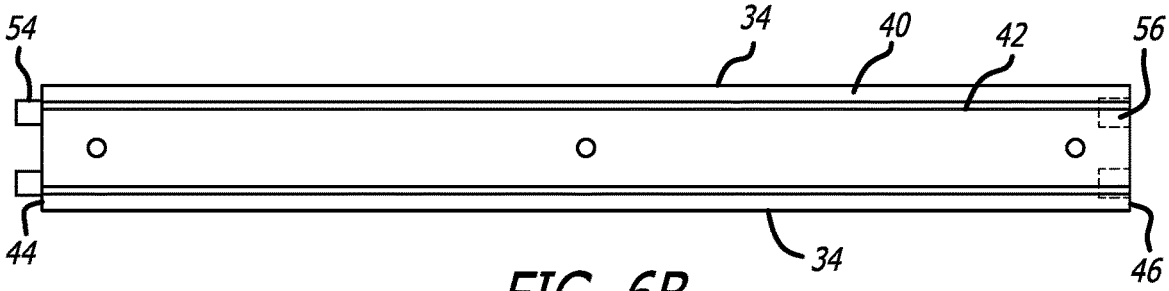
FIG. 6B is a top view of the second embodiment of the cast concrete body of an in-ground lighting assembly of the present invention.

FIG. 5A is a side view of the first embodiment of the cast concrete body 10 and FIG. 5B is a side view of the second embodiment of the cast concrete body 30 of the in-ground lighting assembly of the present invention. FIG. 6A is a top view of the first embodiment and FIG. 6B is a top view of the second embodiment of the in-ground lighting assemblies of the present invention.

As depicted in FIGS. 5A and 6A, the respective ends of the cast concrete body 10 are sealed by the endcaps 16. By comparison, as depicted in FIGS. 5B and 6B, the respective ends of the cast concrete body 30 are open, and the male 54 connecting features extend from the end 44 of the base 32 of the cast concrete body 30. The female 56 connecting features are illustrated by the dashed lines at the end 46 of the base 32 of the cast concrete body 30. It should be appreciated that the cast concrete body 10 of FIGS. 5A and 6A may alternatively be configured to have one end thereof incorporate the open-channel end design of FIGS. 3, 4 and 5B, to terminate the ends of an assembly including one or more of the cast concrete bodies 30.

FIG. 7 is a top view of a third embodiment of the cast concrete body 70 of an in-ground lighting assembly of the present invention having a curved design. The cast concrete body 70 has a base (hidden in FIG. 7) and sidewalls 74 defining a channel 76 similar to the construction of the above described embodiments. However, the cast concrete body 70 is formed to a curved or arcuate shape as opposed to the linear designs of FIGS. 1 and 3. FIG. 7 thus illustrates the flexibility of the present invention in allowing a non-linear cast concrete body 70 to be formed and joined end-to-end to allow free form designs. The multiple cast concrete bodies 70 depicted in FIG. 7 include respective ends 80 and 82 preferably include interlocking male 84 and female 86 connector features, similar to those described above with respect to FIGS. 3 and 4. FIG. 7 depicts two cast concrete bodies 70 spaced apart in preparation for assembly in the top half of the figure, and two cast concrete bodies 70 joined together in the bottom half of the figure. The end faces of the cast concrete bodies 70 are preferably glued together with a flexible waterproof adhesive and sealant such as MVIS™ Veneer Mortar made by Laticrete International Inc., which allows linear expansion and contraction during climatic changes.

FIGS. 8 and 9 are top views illustrating the steps of forming an angled corner assembly 90 using the cast concrete body 30 described above. The angled corner assembly 90 is formed by cutting one of the cast concrete bodies 30 into three segments, with the two end segments 92 and 94 having opposingly matched angles as depicted in FIG. 8. The two end segments 92 and 94 are then glued together to form the corner. The angle of the corner can be formed from 180 degrees down to about 20 degrees. The angled corner assembly 90 may require a specially formed or cut lens segment. Alternatively, the angled corner assembly 90 may be sealed with a precast cap formed from the same material used for the cast concrete body 30. The finished angled corner assembly 90 is depicted in FIG. 9.

FIGS. 10A and 10B illustrate two basic alternative lens designs for the in-ground lighting assembly of the present invention. FIG. 10A illustrates a light diffusing lens 24A that will provide a soft, glowing light. FIG. 10B illustrates a clear lens 24B that provides a more transmissive lens so that the light may be focused on an architectural feature. Each of the lenses 24A and 24B have a generally trapezoidal shape with a width sufficient to fit within the cast concrete body described above, and a length sufficient to extend the length of the cast concrete body. The lenses 24A and 24B may be formed from glass or high strength acrylic, plastic or natural stone material. It will be appreciated by those skilled in the art that various other types of lenses sizes and shapes may be used with the in-ground lighting assembly of the present invention, for example a beam splitting lens to define light bars or a lens having concave or convex upper or lower surfaces to define a diffusing of focusing lens to diffuse or focus the light beam to highlight a specific feature or provide a desired lighting effect. Further, the lens could be formed with refracting structures molded or extruded on the underside of the lens, or the lens may be formed to include microstructures within the lenses to provide specific lighting effects.

Figure 13:
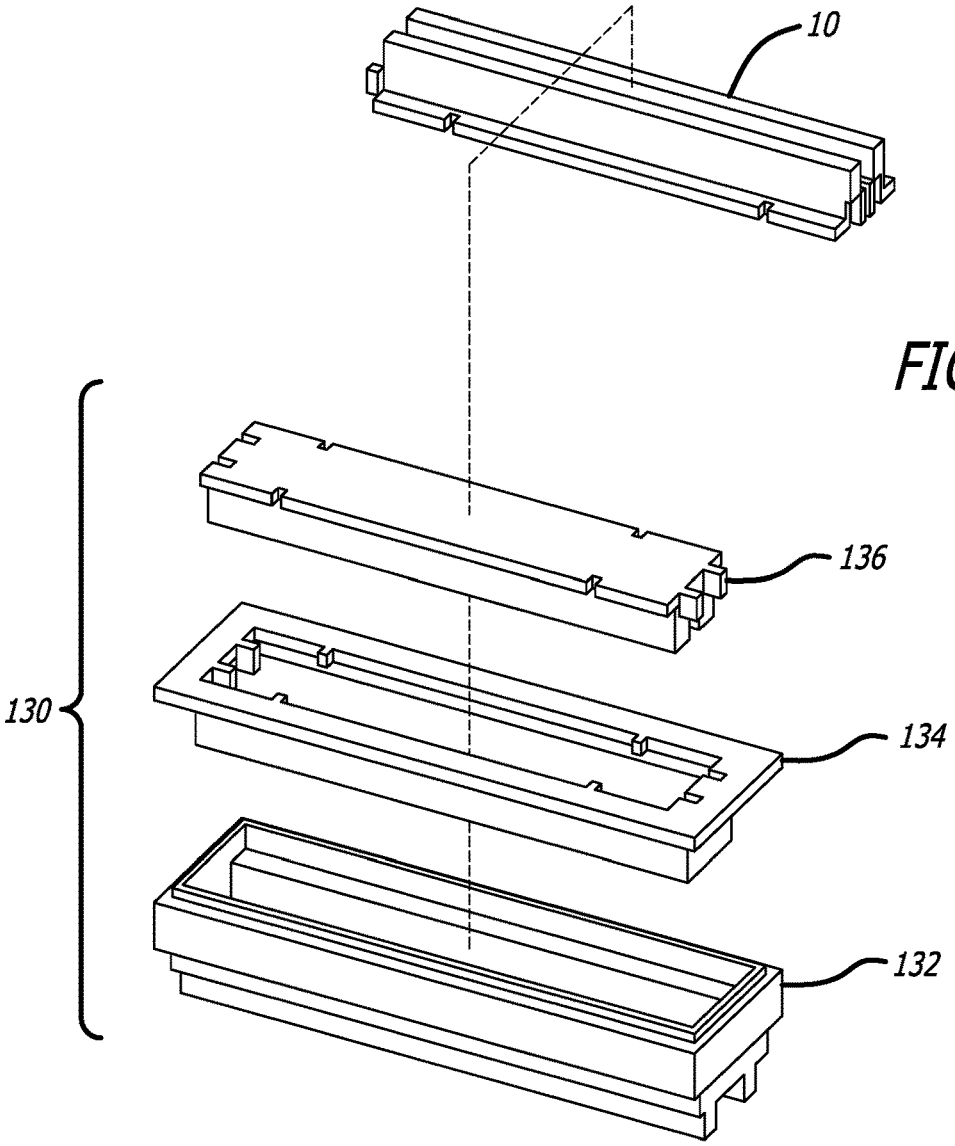
FIG. 13 is a perspective view of a light diffusing lens for the in-ground lighting assembly of the present invention.
Figure 14:
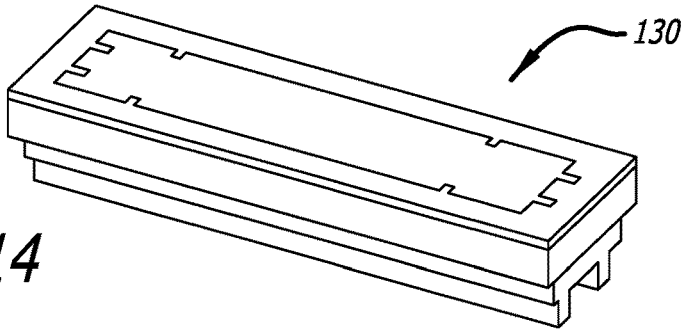
FIG. 14 is a perspective view of a mold assembly for casting the concrete body of the in-ground lighting assembly of the present invention.

FIG. 11 is a perspective view of the channel 26 of the in-ground lighting assembly 10 illustrating a sequence of individual light emitting elements 110 or light emitting diodes ("LED") each having a lens 112 that may be shaped to focus or diffuse the light beam, mounted under a clear cover lens 24. FIG. 12 is a perspective view the channel 26 of the in-ground lighting assembly 10 illustrating a LED light strip 114 within the channel 26. The light strip illustrated in FIG. 12 is available in lengths up two several hundred feet long, and when assembled in the in-ground lighting assembly of the present invention they provide a continuous light over substantial lengths and geometries FIG. 13 is a perspective, exploded view of the mold assembly 130 for forming the cast concrete body of the in-ground lighting assembly of the present invention. FIG. 14 is a perspective view of the assembled mold assembly 130 of FIG. 13. The mold assembly 130 includes a mold base 132, a flexible mold 134 and a precast 136. The mold base may be made from wood, plastic or mortar. The flexible mold 134 is preferably formed from a silicon or similar elastomeric material that holds its shape when supported within the mold base 132 and partially filled with concrete. The precast 136 is shaped to fit into the flexible mold 134, and displace the concrete to define all of the top features of the channel body of the cast concrete body 10. The concrete is allowed to cure for 24 to 48 hours within the mold assembly 130. After the concrete cures, the precast 136 is removed and then the remaining mold assembly with the hardened concrete is flipped over, allowing the mold base 132 to be removed. Finally, the flexible mold 134 is removed from the cast concrete body 10. The flexible mold 132 may be left on the cast concrete body 10 to protect it during transportation to an installation location, however the flexible mold 134 is reusable. As an alternative to forming all of the structural features of the cast concrete body 10 in the molding process, some of the features for example the drain holes or portions of the channel may be drilled or cut into the cast concrete body 10 as a subsequent fabrication step.

Figure 15:
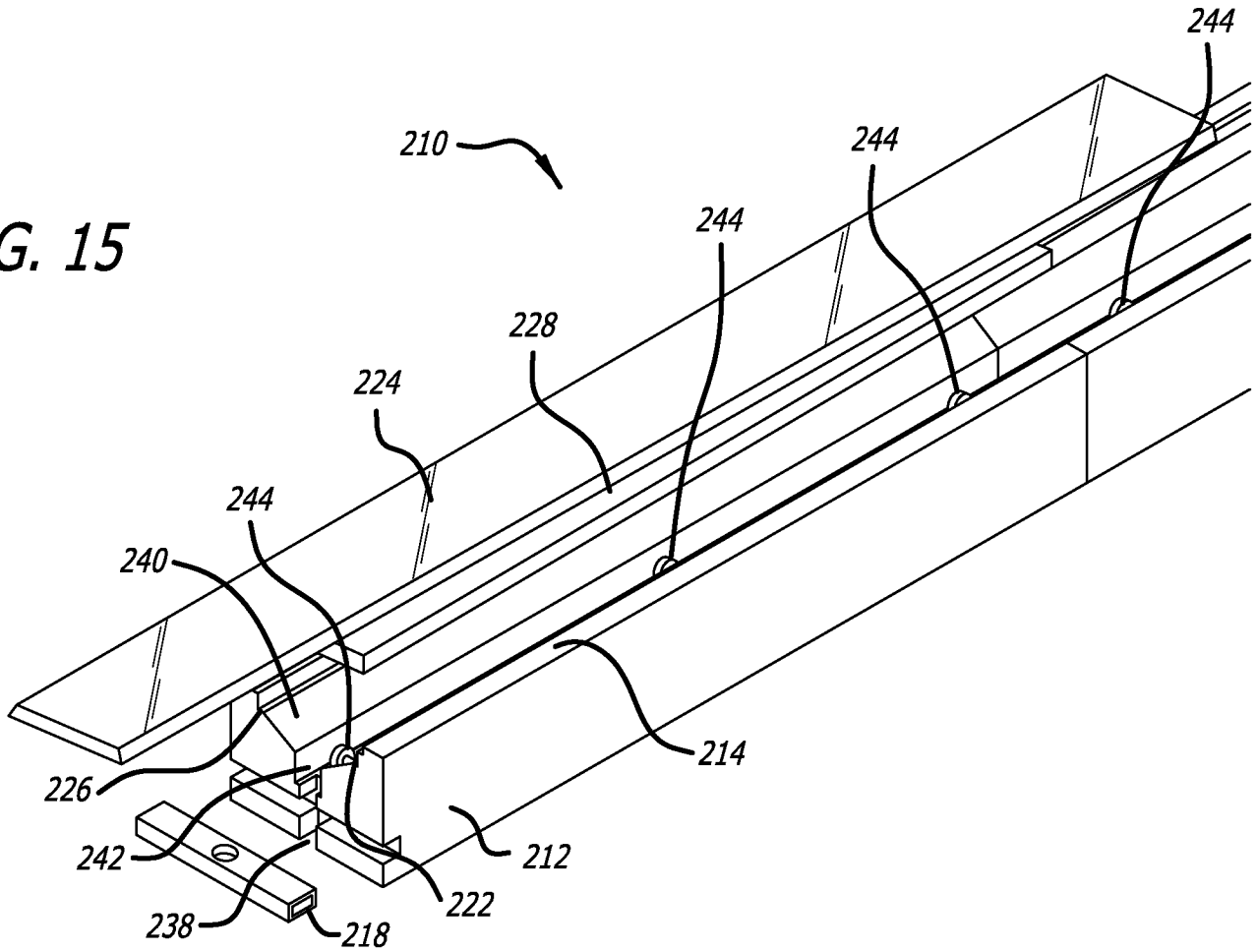
FIG. 15 is a perspective view of an alternative embodiment of the cast concrete body of an in-ground lighting assembly of the present invention.
Figure 16:
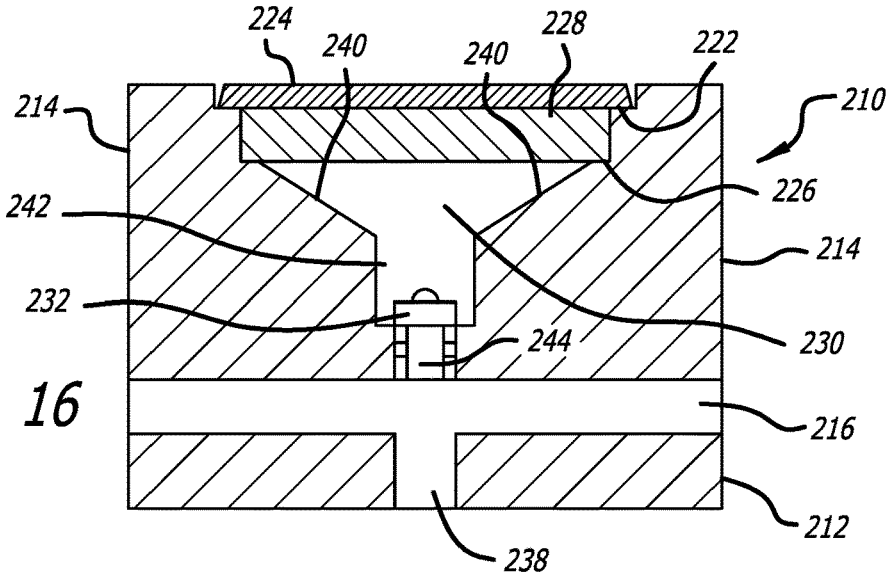
FIG. 16 is an end view of the alternative embodiment of the cast concrete body of FIG. 15.
Figure 17A:
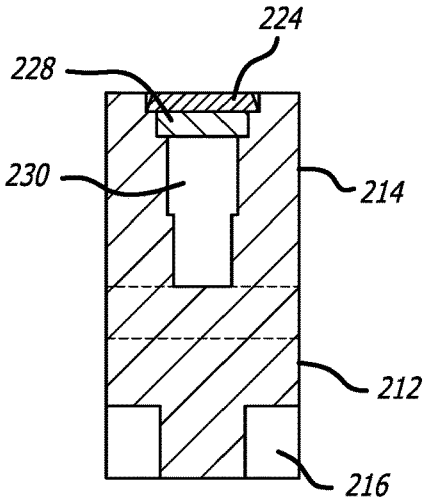
FIG. 17A-E are end views of alternative configurations of the cast concrete body of FIG. 15.
Figure 17B:
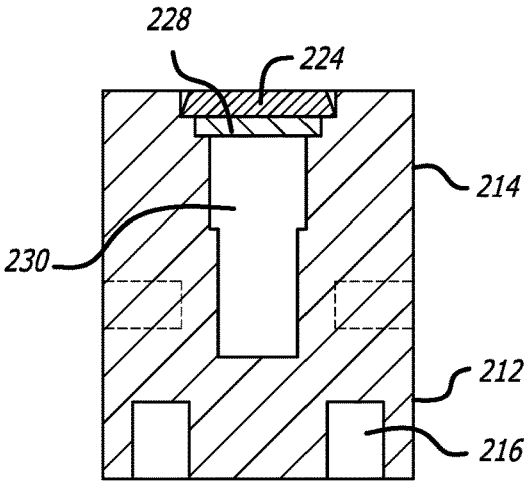
Figure 17C:
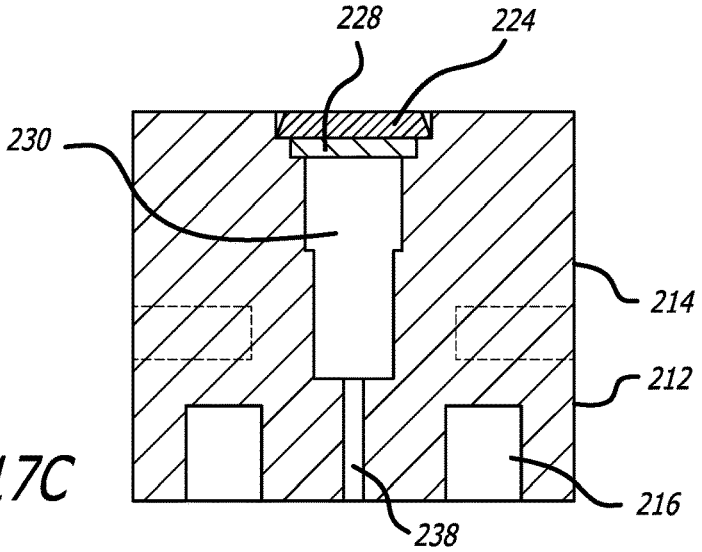
Figure 17D:
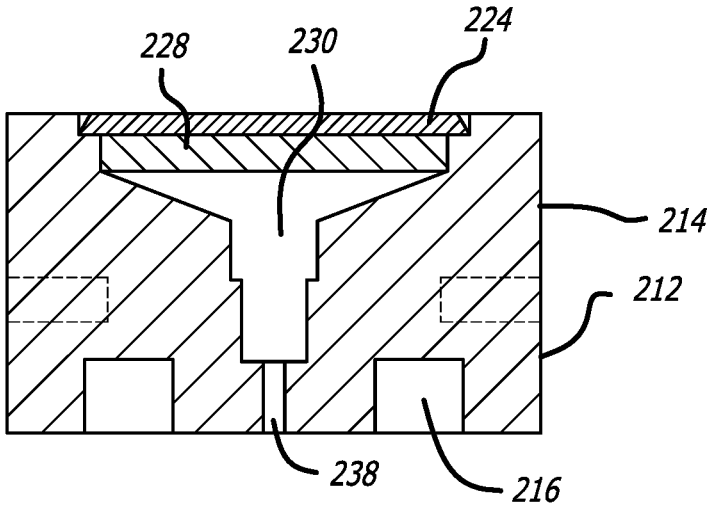
Figure 17E:
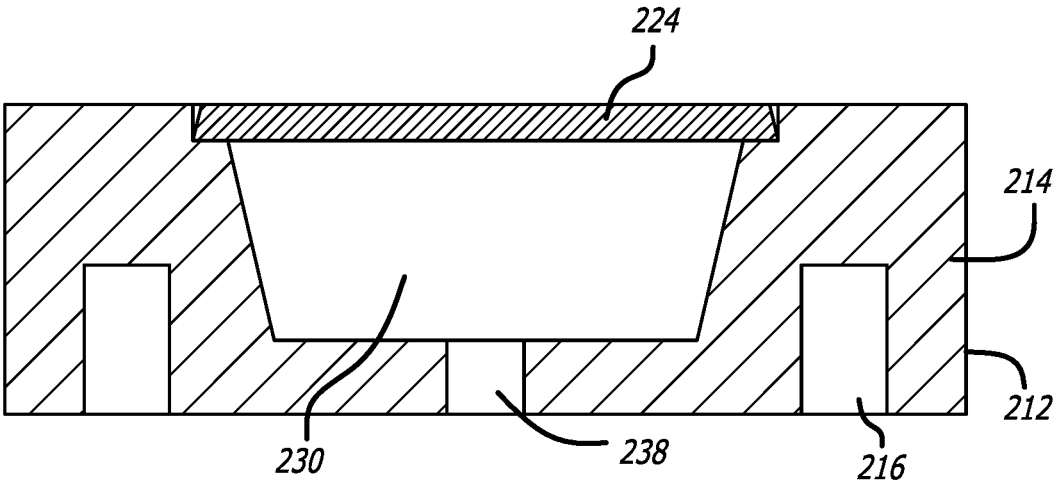

FIG. 15 is another configuration of an embodiment of the cast concrete body 210, which includes a base 212 and sidewalls 214 extending upward from the outer edges of the base 212. FIG. 16 is an end view of the cast concrete body of FIG. 15. The cast concrete body 210 does not include endcaps as in the configuration of FIG. 1. The ends of the base 212 include a slot 216 formed into each lateral end face of the base 212 in the same location. The slot 216 is preferably a ½ inch to 1 inch deep horizontal channel. However, the slot may also be an axial channel extending into the base 212. The slot 216 is configured to receive a connector tube 218, preferably formed from stainless steel, aluminum, ceramic or durable composite or plastic material. The connector tube 218 may be hollow and includes a square or rectangular cross section. The connector tube 218 may also include a centrally located weep hole on its upper and lower surfaces as well as openings at its ends to allow water to drain from the concrete body 210. The configuration of the cast concrete body 210 having slots 216 at each lateral end allows the concrete bodies 210 to be formed in a single mold. While the configuration of the concrete body 210 of FIG. 15 depicts a linear structure, the configuration may be cast as a curved or arcuate shape. In addition, the concrete body may be cut axially to any given length, and then the slot 216 may be cut with a concrete saw blade.

FIGS. 17A, 17B, 17C, 17D, and 17E depict alternative end view cross sectional shapes for the cast concrete body 210. As depicted in FIGS. 17A-17E, the cast concrete body 210 may be formed in the shape of a square or rectangle with three-quarters of an inch to twelve-inch-wide base and three-quarters of an inch to six-inch-tall sides. The lateral end faces of the cast concrete body 210 include the axial channels for receiving a connector tube. The concrete cast body 210 may be formed in lengths from one foot to four or even eight feet in length. As noted above the concrete cast body may be cut axially to a desired length, or to provide an angled connection.

In the configurations of FIGS. 15-17, the base 212 may include one or more drain holes 238 that align with the weep holes of the connector tube 218. The top edges 220 of the sidewalls 214 include a first shoulder 222 formed to support the edges of a lens 224. The upper side of the sidewalls 214 may also include a second shoulder 226, positioned below the first shoulder 222. The second shoulder 226 is formed to support a secondary inner lens 228. The secondary inner lens 228 seals each section of cast concrete body 210 during installation and creates a restricting cavity which guides a flexible LED array 232 (FIG. 16) along an illumination cavity 230 defined by the inside surfaces of the sidewalls 214, enabling the LED array 232 to be installed, replaced, or maintained from one end of an interconnected series of cast concrete bodies 210 without the need to remove the lenses 224 or secondary inner lenses 228. The lens 224 and secondary lens 228 are preferably each sealed and bonded to the sidewalls 214 during assembly. The lens 224 and secondary lens 228 may be secured to the sidewalls with a waterproof adhesive glue or grout. The end of a cast concrete body 210 that terminates the lighting assembly is preferably sealed with a removable endcap.

The sidewalls 214 may also include inwardly sloping interior surfaces 240 that taper to a central channel 242. The central channel 242 may provide support for a series of rolling elements such as wheels, rollers or bearings 244 spaced within the central channel 242 to allow the flexible LED array to be installed atop the wheels, rollers or bearings 244. Alternatively, the flexible LED array may be configured to have wheels, rollers or bearings to cooperatively run across the base 212 or the central channel 242 defined by the sidewalls 214, during installation of the LED array from one end of an interconnected series of cast concrete bodies 210.

As another alternative, the inwardly sloping interior surfaces 240 or the central channel 242 may be coated with a light layer of lubricant, preferably a dry Teflon lubricant, to allow the flexible LED array to easily slide into place without wheels, rollers or bearings.

The inwardly sloping interior surfaces 240 of the sidewalls 214 may be coated or painted with a reflective coating to focus the light towards the lenses. In addition, while the electrical light elements are preferably light emitting diode (LED) lighting fixtures, other types of long length lighting devices such as liquid crystal displays (LCD) and laser lights may also be incorporated into the central channel 242. The cast concrete body 210 is constructed of sufficiently durable materials so as to allow the cast concrete body 210 to be installed in-ground or even in-pavement, with only the upper surface of the lens 224 and top edges 220 of the sidewalls 214 being exposed. The base 212, sidewalls 214 and endcaps of the lighting fixture cast concrete body 10 are formed from concrete, polymer concrete mixtures or other non-corrosive castable or moldable structural materials including high strength plastics and high strength polymers. The base 212 and the sidewalls 214 may also include reinforcing metal rods or fiber materials. The configuration of the cast concrete body 10 adapted to allow wheels, rollers or bearings 224 to guide a long length of a flexible LED array 224, or similar lighting device, into one end of series of interconnected cast concrete bodies 210 after the completion of the installation of the cast concrete bodies 210 allows the labor intensive aspects of the installation to be completed during the construction process. The lighting elements can be fabricated offsite, delivered and installed at the end of the construction process. In addition, the lighting array may be removed and repaired or replaced by accessing only one end of the installation. Thus, for example, a ninety five foot long channel formed by end to end installed cast concrete bodies 210 may be installed in ground, the surrounding pavement, walkways and landscaping can be installed, and then the lighting elements may be installed through one end of the channel and connected to a power supply. If maintenance is required, the endcap is removed, the lighting array is pulled out and repaired or replaced, and the end cap is reinstalled.

Figure 18:
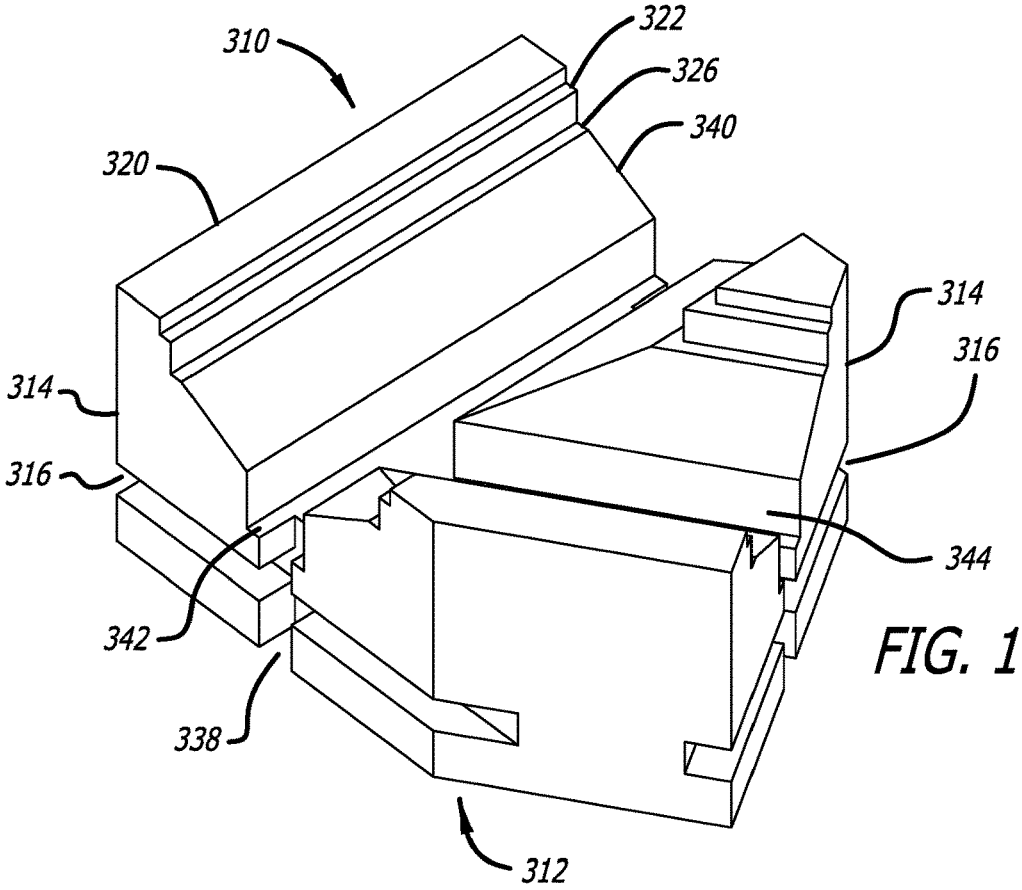
FIG. 18 is an isometric view of a representative embodiment of a fixture junction cast concrete body.
Figure 19:
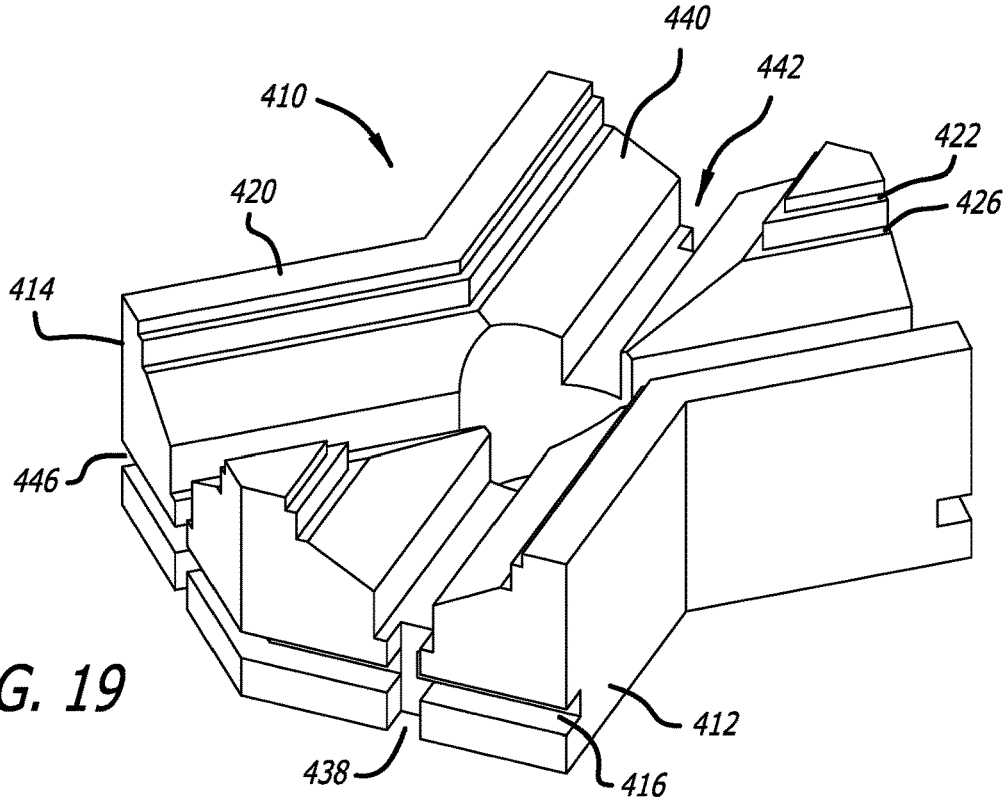
FIG. 19 is an isometric view of a representative embodiment of a crossover junction cast concrete body.

In some installations, it may be advantageous to allow the light structure to branch into two directions or cross over at a junction. FIG. 18 is an isometric view of a representative embodiment of a fixture junction cast concrete body 310. FIG. 19 is an isometric view of a representative embodiment of a crossover junction cast concrete body 410.

The fixture junction cast concrete body 310 of FIG. 18 includes a base 312, sidewalls 314 and channels 316 on the lateral end faces. The top edges 320 of the sidewalls 314 include a first shoulder 322 formed to support the edges of a lens (not shown). The upper side of the sidewalls 314 may also include a second shoulder 326, positioned below the first shoulder 322. The second shoulder 326 is formed to support a secondary inner lens (not shown). The secondary inner lens seals each section of cast concrete body 310 during installation and creates a restricting cavity which guides a flexible LED array 232 (FIG. 16) along a first illumination cavity 342 or branched into a second illumination cavity 344, each defined by the inside surfaces of the sidewalls 314. The second illumination cavity 344 may diverge from the first illumination cavity 342 at any desired angle from about zero degrees to about ninety degrees. The base 312 may include drain holes 338.

The fixture junction cast concrete body 310 allows a pair of LED arrays to be installed, replaced, or maintained from one end of an interconnected series of cast concrete bodies of FIGS. 1-17. The lens and secondary inner lens may be finally installed after the LED array is in place, allowing the installer to easily divert one LED array into the second illumination cavity 344. The lens and secondary lens are preferably each sealed and bonded to the sidewalls 314 during assembly, or after installation of the LED array, as described above. The sidewalls 314 may also include inwardly sloping interior surfaces 340 that taper to define the first illumination cavity 342 and second illumination cavity 344, each of which may include a series of wheels, rollers or bearings to allow the flexible LED array to be installed atop the wheels, rollers or bearings.

The crossover junction cast concrete body 410 of FIG. 19 includes a base 412, sidewalls 414 and channels 416 on the lateral end faces. The top edges 420 of the sidewalls 414 include a first shoulder 422 formed to support the edges of a lens (not shown). The upper side of the sidewalls 414 may also include a second shoulder 426, positioned below the first shoulder 422. The second shoulder 426 is formed to support a secondary inner lens (not shown). The secondary inner lens seals each section of cast concrete body 410 during installation and creates a restricting cavity which guides a flexible LED array 432 (FIG. 16) along a first illumination cavity 442. A second LED array may be installed into a second illumination cavity 446, also defined by the inside surfaces of the sidewalls 414, but having a depth allowing the second LED array to pass over (or under) the first LED array. The second illumination cavity 446 may intersect the first illumination cavity 442 at any desired angle. The base 412 may include drain holes 438.

The crossover junction cast concrete body 410 allows a pair of LED arrays to be installed, replaced, or maintained from the respective ends of an intersecting pair of interconnected cast concrete bodies of FIGS. 1-17. The lens and secondary inner lens may be finally installed after the LED arrays are in place, allowing the installer to easily divert one LED array over or under the second LED array at the crossover junction. The lens and secondary lens are preferably each sealed and bonded to the sidewalls 414 during assembly, or after installation of the LED arrays, as described above. The sidewalls 414 may also include inwardly sloping interior surfaces 440 that taper to define the first illumination cavity 442 and second illumination cavity 446, each of which may include a series of wheels, rollers or bearings to allow the flexible LED array to be installed atop the wheels, rollers or bearings.

The cast concrete bodies 10, 30, 70, 210, 310 and 410 are preferably formed from concrete, polymer concrete mixtures or other non-corrosive castable or moldable structural materials including for example plastics and high strength thermoplastic or resin materials capable of bearing substantial loads. The pre-cast lighting fixture is a self-supporting structure capable of being placed in the ground without additional structural materials or the need to pour concrete in place. Pre-cast lighting fixture sections of various lengths can be interconnected to form infinitely continuous lines of light in roadways, entrances or pathways, without the need for complicated forms or shuttering to be built to set the lights in place. The pre-cast lighting fixture may alternatively be used to house other electronic components for intelligent roadways and pathways, for example housing cellular, wi-fi or other wireless communication technologies enabling vehicular communication and automation.

The pre-cast light fixture defines a channel running the full length of the body, with white or light colored reflective sides, which may be angled or shaped to reflect light in a specific pattern. The pre-cast light fixture is designed to contain sealed waterproof LED array or interconnecting arrays or continuous sealed LED strips which may be secured in place by adhesive materials or channels made from plastic or non-corrosive metal or other materials, or a secondary channel cast in to the base of the main channel. Each side of the channel preferably has the shoulders or ledges formed to support a flush fitting lens or pair of lenses. The lens may be made of plastic or glass or formed from light transmissive materials including natural stone.

Preferably, the lens should be capable of supporting the weight of automobile and truck traffic for in-pavement locations, thus at least capable of supporting 150 kPa to 700 kPa. However, for architectural lighting uses the lens may not need to be capable of supporting vehicular traffic. The lens may be trapezoidal with its narrowest width at the upper position to leave an even space which will allow a sealant or grout material to be applied to secure and seal the lens in position. The main channel within the cast concrete body may have open ends to allow continuous LED lighting arrays or strips to run from section to section of the pre-cast units to create continuous lines of light, or they may have closed ends to seal the fixture as an individual unit. Interlocking connectors and recesses at opposite ends of the fixtures enable fixtures to align and lock together to form continuous linked lines or shapes.

Abutting ends of interconnecting pre-cast sections are preferably glued with a flexible waterproof adhesive/sealant which allows linear expansion and contraction during climatic changes. The linear lighting arrays are secured within the channel, which is enclosed by structural weight bearing plastic or glass lenses, each being longer than a single pre-cast section so that it bridges the joint of each section. The lenses will be supported by load bearing shoulders or ledges which are formed in the pre-cast structure, and are designed to be sealed in place with a waterproof adhesive glue or grout.

Assembly and installation of the cast concrete body sections is achieved by setting the first section on a level bed of sand or other level surface; applying a thin film of adhesive sealant to the end face of the cast concrete body section containing the female interconnector recesses and then placing a second cast concrete body section having the male interconnectors in to place to form a continuous channel. Multiple sections are interconnected until the complete linear or curvilinear light is in place. Open ends are sealed with endcaps, or where circles or similar forms are created the last section is set in place as a keystone after removing the interlocking male interconnectors. Waterproof LED or other illuminating lamps are installed in the channel by appropriate support structures such as formed supports or recesses in the channel, or other secondary supports of non-corrosive materials. Liquid tight connectors enable power to be supplied to the lights through round holes cast or drilled into the cast concrete body sections or at the ends of connected runs, and cable routing components enable continuous power connector cords or wire to be run throughout the lighting channel to allow power connections.

Alternatively, the lenses of the assembly may be formed as a structural architectural glass having embedded LEDs within the glass. The embedded LEDs are provided with electrical power circuitry within the glass which allows for the design of an illuminating lens capable of color change and being digitally addressed and controlled to display or project messages or images. These types of glass assemblies are currently available and readily adapted to be included as the lens or under a clear lens in the in-ground lighting assembly of the present invention.

Various alternative styles are envisaged where the design details allow for different conditions and finished appearance. The invention has been described in detail above in connection with the figures, however it should be understood that the system may include other components and enable other functions. Those skilled in the art will appreciate that the foregoing disclosure is meant to be exemplary and specification and the figures are provided to explain the present invention, without intending to limit the potential modes of carrying out the present invention. The scope of the invention is defined only by the appended claims and equivalents thereto.

The invention claimed is:

1. An architectural light housing assembly comprising:

a housing body having a base and opposing sidewalls defining a stepped elongated channel, said opposing sidewalls each having upper and lower interior contour shoulders, said housing body formed from a castable material selected from the group consisting of concrete, a polymer concrete mixture, high strength plastic and high strength polymer;

at least one elongated lens mounted onto said upper interior contour shoulder of said opposing sidewalls sealing an upper portion of said elongated channel;

a central channel within the lower section of said housing body;

a plurality of rolling elements selected from the group consisting of wheels, rollers or bearings, said rolling elements positioned within said central channel within the lower section of said housing body; and attachment structures to align and securely couple said housing body to at least one of a second housing body and an endcap.

2. The architectural light housing assembly housing body of claim 1, further comprising:

a third interior shoulder on each of said interior surfaces of said sidewalls; and a second lens mounted on said third interior shoulder of each of said interior surfaces of said sidewalls.

3. The architectural light housing of claim 1, wherein said at least one lens is a material selected from the group consisting of clear glass, frosted glass, high strength acrylic, plastic and natural stone.

4. The architectural light housing of claim 1, wherein said cast body is two feet to eight feet in length.

5. The architectural light housing of claim 1, further comprising: male and female connecting features formed on at least one end of said cast body, said male and female connecting structures having a square, round, oval, triangles or rectangular shape.

6. The architectural light housing of claim 1, wherein said cast body and elongated lens can support a load exceeding 150 kPa.

7. The architectural light housing of claim 1, wherein said plurality of cast concrete bodies have a channel shape selected from the group consisting of straight, arcuate, curving, angled, branching and intersecting.

8. The architectural light housing of claim 1, wherein said at least one lens has at least one of: a concave or convex surface, refracting structures molded or extruded on an underside of said lens, and microstructures within the lens to provide lighting effects.

9. An architectural light housing assembly comprising:

a plurality of cast concrete bodies each having a base and opposing sidewalls defining at least one elongated channel, said opposing sidewalls each having at least one interior contour shoulder, said housing body formed from a castable material selected from the group consisting of concrete, a polymer concrete mixture, high strength plastic and high strength polymer;

a plurality of rolling elements selected from the group consisting of wheels, rollers or bearings, said rolling elements positioned within said elongated channel;

connecting attachment structures formed on at least one end of each of said plurality of cast concrete bodies to align and attach said cast concrete bodies in an end to end assembly to form a continuous elongated channel;

an adhesive applied to end faces of said cast concrete bodies forming a flexible waterproof adhesive and sealant between linearly adjacent cast concrete bodies;

at least one elongated lens mounted onto said interior contour shoulders of said opposing sidewalls affixed with a waterproof adhesive sealing an upper portion of said elongated channel; and an elongated lighting element installed within at least a portion of the length of said elongated channel.

10. The architectural light housing assembly housing body of claim 9, further comprising:

a third interior shoulder on each of said interior surfaces of said sidewalls; and a second lens mounted on said third interior shoulder of each of said interior surfaces of said sidewalls.

11. The architectural light housing of claim 9 wherein said at least one lens is a material selected from the group consisting of clear glass, frosted glass, high strength acrylic, plastic and natural stone.

12. The architectural light housing of claim 9, wherein said cast body is two feet to eight feet in length.

13. The architectural light housing of claim 9, further comprising: male and female connecting features formed on at least one end of said cast body, said male and female connecting structures having a square, round, oval, triangles or rectangular shape.

14. The architectural light housing of claim 9, wherein said cast body and elongated lens can support a load exceeding 150 kPa.

15. The architectural light housing of claim 9, wherein said plurality of cast concrete bodies have a channel shape selected from the group consisting of straight, arcuate, curving, angled, branching and intersecting.

16. The architectural light housing of claim 9, wherein said at least one lens has at least one of: a concave or convex surface, refracting structures molded or extruded on an underside of said lens, and microstructures within the lens to provide lighting effects.

17. A cast concrete body for an architectural light housing, the cast concrete body comprising:

a cast concrete body housing including a base and opposing sidewalls extending upward from said base, each of said sidewalls having an interior surface forming opposing sides of at least one elongated lighting element channel, said opposing sidewalls each having at least one interior contour shoulder, said cast concrete housing body formed from a castable material selected from the group consisting of concrete, a polymer concrete mixture, high strength plastic and high strength polymer;

a plurality of rolling elements selected from the group consisting of wheels, rollers or bearings, said rolling elements positioned within said elongated channel;

connecting attachment structures formed on at least one end of said cast concrete body housing; and at least one elongated lens mounted onto said interior contour shoulders of said opposing sidewalls and affixed with a waterproof adhesive sealing an upper portion of said elongated channel.

18. The architectural light housing assembly housing body of claim 17, further comprising:

a third interior shoulder on each of said interior surfaces of said sidewalls; and a second lens mounted on said third interior shoulder of each of said interior surfaces of said sidewalls.

19. The architectural light housing of claim 17, wherein said at least one lens is a material selected from the group consisting of clear glass, frosted glass, high strength acrylic, plastic and natural stone.

20. The architectural light housing of claim 17, wherein said cast body is two feet to eight feet in length.

21. The architectural light housing of claim 17, further comprising: male and female connecting features formed on at least one end of said cast body, said male and female connecting structures having a square, round, oval, triangles or rectangular shape.

22. The architectural light housing of claim 17, wherein said cast body and elongated lens can support a load exceeding 150 kPa.

23. The architectural light housing of claim 17, wherein said plurality of cast concrete bodies have a channel shape selected from the group consisting of straight, arcuate, curving, angled, branching and intersecting.

24. The architectural light housing of claim 17, wherein said at least one lens has at least one of: a concave or convex surface, refracting structures molded or extruded on an underside of said lens, and microstructures within the lens to provide lighting effects.

* * * * *